US006244187B1

(12) United States Patent
Head

(10) Patent No.: US 6,244,187 B1
(45) Date of Patent: Jun. 12, 2001

(54) INCREASED VELOCITY-PERFORMANCE-RANGE BULLET

(75) Inventor: Lawrence P. Head, Cedar, MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

(21) Appl. No.: 09/346,182

(22) Filed: Jul. 1, 1999

(51) Int. Cl.[7] ..... F42B 12/04

(52) U.S. Cl. ..... 102/516; 102/507; 102/508; 102/518; 102/519; 102/514

(58) Field of Search ..... 102/516, 514, 102/518–519, 507–508

(56) References Cited

U.S. PATENT DOCUMENTS

| | | | | |
|---|---|---|---|---|
| 2,309,360 | | 1/1943 | Southwell et al. . | |
| 2,321,344 | | 6/1943 | Whipple . | |
| 2,327,950 | * | 8/1943 | Whipple | 102/516 |
| 2,838,000 | | 6/1958 | Schreiber . | |
| 3,003,420 | | 10/1961 | Nosler . | |
| 3,069,748 | | 12/1962 | Nosler . | |
| 3,143,966 | | 8/1964 | Burns, Jr. et al. . | |
| 3,345,949 | | 10/1967 | Nosler . | |
| 3,349,711 | | 10/1967 | Darigo et al. . | |
| 4,336,756 | | 6/1982 | Schreiber . | |
| 4,503,777 | | 3/1985 | Young . | |
| 4,750,427 | | 6/1988 | Carter . | |
| 4,793,037 | | 12/1988 | Carter . | |
| 4,805,536 | | 2/1989 | Kosteck . | |
| 4,856,160 | | 8/1989 | Habbe et al. . | |
| 4,879,953 | | 11/1989 | Carter . | |
| 5,099,765 | * | 3/1992 | Czetto, Jr. | 102/511 |
| 5,454,325 | | 10/1995 | LeBlanc . | |
| 5,528,989 | | 6/1996 | Briese . | |
| 5,569,874 | | 10/1996 | Nelson . | |
| 5,621,186 | | 4/1997 | Carter . | |
| 6,016,754 | * | 1/2000 | Enlow et al. | 102/516 |
| 6,085,661 | * | 7/2000 | Halverson et al. | 102/516 |

OTHER PUBLICATIONS

Lapua Catalog (Sheets).

* cited by examiner

*Primary Examiner*—Michael J. Carone
*Assistant Examiner*—L. Semunegus
(74) *Attorney, Agent, or Firm*—Schroeder & Siegfried P.A.

(57) ABSTRACT

A mushrooming bullet having a highly improved performance in the retention of the lead core within the bullet jacket subsequent to impact, and in performing effectively over a substantially wider velocity range, the bullet retaining its lead core within its jacket substantially 98–100% of its firings at high velocities, and mushrooming more effectively at lower velocities than conventionally manufactured bullets. The jacket is characterized by a base portion which has a substantially larger interior diameter than its shank portion, and a mouth portion which is substantially softer than its shank portion. The mushrooming of the nose portion of the core and the mouth portion of the jacket is effectively arrested by the harder thick shank portion when the bullet strikes a target, and thereby minimizes the loss of lead from the core. The jacket is further characterized by an annular transition shoulder which extends inwardly from the jacket's base portion to its shank portion at an angle to the longitudinal axis of the jacket of at least 7.5 degrees and a radial distance of at least 0.020", to thereby effectively lock the core within the jacket. The shank portion has a hardness at its rear end of about 145 DPH, which decreases gradually until it joins the mouth portion, at which it has a DPH of about 125 DPH. The mouth portion has a hardness of about 125 DPH at its rear end, which increases gradually to the tip of its mouth at which it has a hardness of about 145 DPH.

42 Claims, 2 Drawing Sheets

INCREASED VELOCITY-PERFORMANCE-RANGE BULLET

BACKGROUND OF THE INVENTION

Muzzle velocities of bullets in small arms ammunition have been increasing steadily since the adoption of smokeless powder as a propellant. All lead bullets, fired at high velocity, will slip relative to the barrel or rifle, and consequently will not be caused to spin sufficiently, thereby causing unstable flight. It also results in unacceptable fouling of the bore of the rifle. With the higher velocities came the requirement to encase the lead cores of the rifle bullets with a relatively hard jacket.

Over the years, the development of faster and flatter shooting cartridges has caused the rifle user to desire a bullet which will perform well at longer and longer ranges while still performing adequately at short ranges. The desired window of operating performance has been widening at both the high end and the low end velocities. In order for the bullet to perform well at these two velocity extremes, several things must occur.

At the low velocity end of the window, the bullet must be sufficiently weakened to initiate a low velocity expansion. A number of patents have issued with various concepts as to how to accomplish such expansion and such velocities. Some of the most notable and commonly used methods today include that of the Whipple U.S. Pat. No. 2,327,950, which utilizes a tapered wall thickness which is progressively thinned toward the mouth of the jacket, along with a top edge which is scalloped. A somewhat similar concept is disclosed and utilized in the Burns & Schreiber U.S. Pat. No. 3,143,966. This patent teaches that the tapering mouth of the jacket should be folded or "inwardly-pinch pleated". Another of the most common methods is that taught by Schreiber U.S. Pat. No. 2,838,000 in which longitudinally extending troughs, or thinned areas of the jacket, extend rearwardly from the mouth of the jacket. Each of these methods has been somewhat successful, in various degrees, in initiating low-velocity expansion of the bullet.

The method of the French U.S. Pat. No. 2,765,738 is interesting, although it is not commonly used. The inventor uses a process in which the mouth of the jacket is formed with longitudinally extending, alternating thick and thin sections, such as those formed by a faceted punch. The jacket is then annealed, and finally, drawn an additional time to a uniform wall thickness. The result of this process is a jacket with longitudinally extending hard and soft sections at the mouth of the jacket.

At the other end of the window, bullets must be sufficiently strong to withstand the extremely high stress load imposed upon it by high velocity impacts. This requires some feature which will slow down and stop the expansion process before the bullet over-expands and fragments. In most conventional bullets, this feature is provided to a limited extent by thickening the jacket wall. This method works reasonably well; however, it has a significant drawback in that it has a fairly small performance operating window. To understand the reason for this drawback, one must look at the methods used for manufacturing most conventional jackets.

The method most commonly utilized is one in which a cup is formed from a flat sheet of copper or brass. This cup has a relatively thick wall and is usually softened prior to subsequent forming operations by annealing same. The cup is then run through a draw operation which reduces the wall thickness and correspondingly lengthens the jacket. This drawing process, however, work-hardens the jacket material.

Some of such jackets may have the final desired wall thickness and mouth taper after a single draw operation. Others may require two or more draws with an intermediate annealing step. In either case, however, the final jacket is relatively hard, usually with the mouth portion being harder than the shank portion. This is due to the required mouth-tapering operation which work-hardens the mouth much more than the thicker-walled shank because the metal is moved to a greater extent.

A bullet made from a jacket having a mouth harder than its shank limits the performance operating window of the bullet. Thus, if the bullet made by the above practices is sufficiently soft or weak to initiate expansion at low velocity, it is then too soft or weak to withstand the high loads imposed thereupon at high velocity impacts, and the bullet will then fragment or disintegrate. Conversely, if the bullet is made in accordance with the above procedures, and is sufficiently strong to withstand the high velocity loads, then it is too hard and strong to initiate expansion at low velocity. Bullets of this type typically have an operating window of about 600–700 FPS. The advantage of this type of bullet is that it is relatively inexpensive to manufacture. Bullet manufacturers have, for the most part, set the operating window requirements to be between about 2,000 FPS and 2,700 FPS. Below 2,000 FPS, the bullets so manufactured do not expand; and above 2,700 FPS, significant fragmentation occurs. Thus, it is apparent that there is a significant need for bullets having a substantially widened performance operating window.

Some bullet manufacturers have been successful in overcoming this problem by designing bullets which are relatively expensive to manufacture. Most notably, the Trophy Bonded Bearclaw bullet uses a jacket having a soft mouth due to the bonding process used in the manufacture of the bullet, and yet has a solid shank which stops the expansion. Another concept which is utilized is the Nosler Partition, which has a center rib that stops the expansion. The disadvantage of these designs, however, is the substantially higher manufacturing cost.

Present day bullet needs continue to increase. Specifically, hunters have increasingly demanded bullets of improved performance. Thus, the desired ranges have steadily increased, as have the performances for a given range. As a consequence, there is a need for a rifle bullet of any given caliber which will perform adequately over an ever-expanding distance range.

The mushrooming bullet has been designed to provide marked increase in shock. Problems with respect thereto have risen, however, with respect to fragmentation, with attendant reduction in shock, damage to game meat, etc. Ideally, the mushrooming bullet would remain intact throughout, but such has not been the case. For high velocities, means for slowing down and eventually stopping the expansion process, before the bullet over-expands and fragments, is needed. This function is provided by the relatively hard thick shank of my bullet jacket.

Penetration is also a desirable feature in a bullet, but it is improved only by retaining its initial shape, which is the antithesis of mushrooming. One of its most serious problems is the tendency of a bullet's lead core to separate from its metal jacket and , in general, to disintegrate and/or lose momentum when such separation takes place.

In seeking to solve the above problems and others, ammunition manufacturers have made numerous changes from time to time, until today the jacket of a conventional bullet has a mouth portion which is harder than its shank, which limits the performance operating range of the bullet. Since the velocity of a bullet decreases with distance from the muzzle of the rifle, the velocity of the bullet is less when it reaches a long range shot target than a short range shot target.

Variations in the strength of the bullet for expansion are conventionally provided by varying the strength of the jacket adjacent its mouth. Thus, it is common to weaken the mouth portion of the jacket when it is desired to facilitate the initiation of expansion, commonly referred to as "mushrooming."

Today, if the jacket is sufficiently soft or weak adjacent its mouth to initiate expansion at low velocity (such as found at long range shots), it is then too soft or weak to withstand the high forces it is subjected to at high velocity impacts provided by short range shots. As a consequence, such a bullet will fragment or disintegrate under such high forces.

Conversely, if the jacket is made to be sufficiently strong to withstand the high velocity forces (as provided by short range shots), then it is too hard and strong to initiate expansion at low velocity (as provided by long range shots) which results in reduced effectiveness of the bullet. Such a bullet penetrates but has no expansion.

Bullet manufacturers recognize the above problems and seek to solve them by seeking a middle-ground somewhere in between the ideal velocities for short and long range shots. Thus, they have adopted a relatively narrow operating window by producing bullets having a window of only about 2,000 fps–2,700 fps. Such bullets typically will not expand at velocities of less than 2,000 fps. Likewise, such bullets will typically fragmentize significantly at velocities above 2,700 fps. Manufacturers produce and market bullets having such narrow operating windows because they are relatively inexpensive to produce, and because no one has heretofore proposed a correspondingly inexpensive bullet which will meet the requirements for a wider operating window.

BRIEF SUMMARY OF THE INVENTION

I have developed a concept under which it is possible to manufacture a jacket relatively inexpensively and having a relatively soft, thin mouth, and a relatively hard, thick shank. The soft, weak mouth expands at very low velocities and the relatively hard, thick shank causes the mushrooming of the core to discontinue when the bullet strikes a target. As a consequence, my bullet will expand at very low velocities in the order of 1,500 FPS and yet is hard and strong enough to withstand forces generated by 3,000+ FPS impacts. This bullet essentially doubles the velocity performance window of conventionally manufactured bullets, while adding only minimal costs to the same, yet performing as well as or better than the more costly concepts. We are able to produce such bullets through the use of only conventional processes. Consequently, the cost thereof is not a determining factor.

An important feature of a good bullet is a design which will retain the lead core inside the jacket after the bullet impacts against its target. Such a design results in the bullet maintaining a high retained weight, and provides deeper penetration. Although a number of patents have been issued for concepts which attempt to do this, this has been accomplished only by relatively expensive procedures. For example, the Trophy Bonded Bearclaw bonds the core to the jacket, and the Nosler Partition has two cores, with the rear core entirely encapsulated by the jacket. These and other bullets which seek to provide this feature are relatively expensive and some have other disadvantages as well.

Several patents have issued for concepts attempting to hold the core in place with conventional bullet design. One of the earliest of these patents is Whipple, U.S. Pat. No. 2,321,344, in which the inventor sought to create a mechanical lock between the core and jacket. The patent pictorially shows a slightly enlarged portion at the rear of the jacket. However, in practice this cavity, when produced, is quite small and not very effective. The drawing process outlined in this patent is simply not conducive to creating a large cavity. Moreover, the diameter of the shank portion is substantially equal to the diameter of the cavity at the base of the jacket and, as a consequence, the latter is ineffective for its intended purpose.

Another patent with a somewhat similar concept is U.S. Pat. No. 4,856,160, issued to Habbe & Bockstruck. This concept provides for a gentle, hourglass-shaped internal cavity. It is intended to thereby mechanically lock the core in place by the "reverse taper" of the hourglass-shaped cavity. In practice, however, this gentle reverse taper is inadequate as it cannot possibly hold the core in place when subjected to high-impact forces, and therefore it separates.

Another patent, U.S. Pat. No. 4,336,756, issued to Schreiber, utilizes a small, annular ring of the jacket, which protrudes into the core. Another similar method utilized is to add one or more cannelures to the bullet shank. These are all efforts made in an attempt to mechanically lock the core to the jacket; however, they have all been only marginally successful and the users thereof cannot predict satisfactory results with any degree of confidence. Although these methods are designed to aid, somewhat, in holding the core securely to the jacket, a general and common failure of these bullets is that the core separates from the jacket upon impact.

My jacket is characterized by the use of a relatively large cavity at the rear of the jacket, with a relatively sharp transition shoulder extending between the forward edge of the enlarged cavity to the inner walls of the shank portion, which are substantially thick. Thus, my bullet has a relatively sharp transition shoulder between the large cavity at the base end of the bullet, and the relatively small diameter of the shank portion thereof. This provides for a large enough mechanical interference (at least 0.040") between the core and the jacket to prevent the core from pulling out during impact. Prior designs and concepts have not been satisfactorily successful in accomplishing this objective.

The conventional bullets now on the market have jackets in which the softer portions are at the base of the bullet and the jacket gets progressively harder as you move toward the mouth. When these bullets are subjected to high velocity impacts, the bullet continues to expand (mushroom) down the shank portion, toward the base portion, because there is no relatively hard shank portion present to stop such expansion.

In many cases, if the velocity is high enough, the bullet will expand almost down to the base, shedding its core in the process. In addition, the actual value of the hardness is high, being above 190 diamond pyramid hardness (DPH) at its mouth. Such a copper jacket is very brittle, and consequently tears and fragments upon impact. My new bullet as described herein, is much softer, and therefore, much tougher and less likely to fragment, since it has a hardness of 125 DPH at its softest area and 145 DPH at its hardest area.

The jacket mouth of my bullet is relatively thin and is scored or serrated to further weaken the mouth. Also, the jacket wall increases in thickness fairly quickly away from the mouth, and is about 50% to 200% thicker at the shank portion than most conventional bullets. This, in combination with its above softness causes my bullet to expand (mushroom) at very low velocities of about 1500 fps.

An additional feature of my above bullet is the relative hardness of the shank portion, as compared to its mouth portion. The hardness of my bullet jacket at the juncture of its shank and mouth portions is preferably 125 DPH. The hardness of the shank increases to a preferred maximum of 145 DPH as you proceed toward the base portion. This increased hardness, of the shank portion, combined with its relatively thick wall, effectively stops the expansion of the bullet and prevents tearing and fragmentation at impact at high velocities. The softest part of the mouth portion, at 125 DPH, is at the rearmost part of the ogive, from which its preferred hardness increases gradually toward its tip at which it reaches a preferred hardness of about 145 DPH. This increased hardness of the mouth portion is created by the working of the metal in forming the ogive profile. We find that a bullet of the above combination produces a retained weight of 83%–95%, which is substantially higher than that of any known prior art bullets of comparable costs, and provides good expansion and no jacket fragmentation.

In addition to the above, my new bullet is characterized by a jacket having a thick sidewall in its shank portion which increases substantially in hardness from its juncture with its mouth portion (at which it is of substantially equal hardness) toward its juncture with its base portion. The soft nose portion causes the nose of the core to mushroom upon impact at relatively low FPS, and the thick-walled shank portion of the jacket causes the mushrooming to terminate quickly when the bullet has impacted a target at relatively high FPS. The jacket mouth portion has a tapered wall thickness which is progressively thinner toward the mouth of the jacket, and also has internal scores which weaken the jacket and facilitate expansion. This scoring practice provides for a very low velocity expansion and is part of the prior art. The use in combination therewith of a relatively hard, thick-walled shank section such as described herein, however, which stops the expansion process has not been heretofore conceived. The relatively large cavity in the rear portion of the jacket, which creates a substantial mechanical interference fit that retains the core in place at impact, is likewise novel in that the core, when seated into position within the jacket under conventional pressures, necessarily assumes the shape and size of the rear cavity, which in turn creates a substantial shoulder lock which is abrupt and extends radially inwardly. This transition shoulder effectively locks the bulbous rear end of the core within the large cavity at the base portion of the jacket. The shoulder consequently creates a substantial mechanical interference fit that retains the core in place at impact.

These and other objects and advantages of the invention will more fully appear from the following description, made in connection with the accompanying drawings, wherein like reference characters refer to the same or similar parts throughout the several views, and in which:

DETAILED DESCRIPTION OF THE INVENTION

My invention enables us to have a high confidence that the core will be retained within the jacket subsequent to the bullet striking a target, when at high velocities. Other bullets have previously been designed with this intent in mind, but none have been successful in obtaining a consistently satisfactory degree of success to enable them to have a high confidence of retention.

Figure 2:
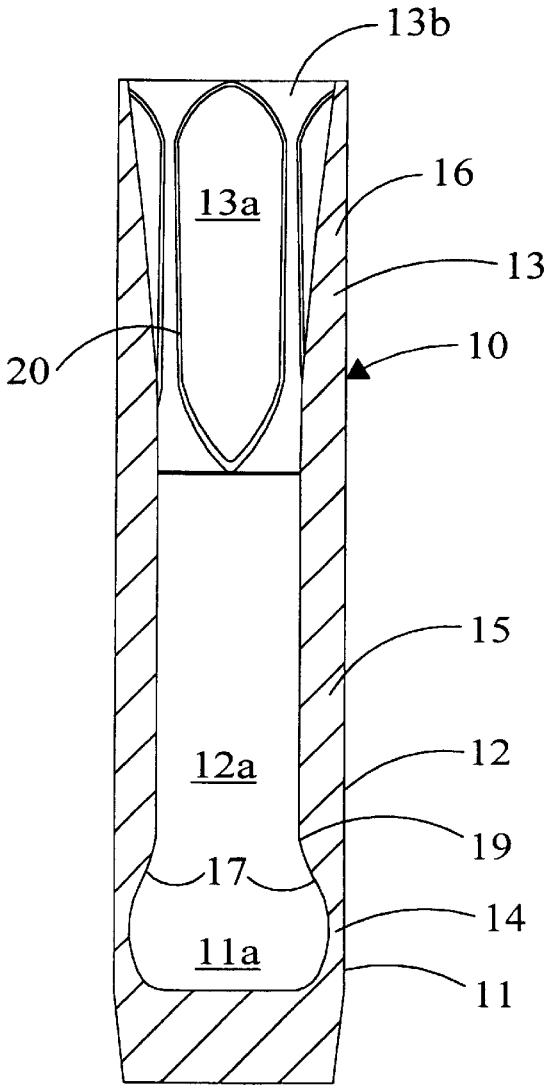
FIG. 2 is a longitudinal sectional view of the jacket of my new bullet, prior to insertion of the bullet core.

Shown in FIG. 2 herein, is my bullet jacket 10 which may be made of suitable metal such as brass or copper. As shown, it includes base portion 11, shank portion 12, and mouth portion 13. The base portion 11 and shank portion 12 have a substantially uniform generally cylindrical exterior, size and shape. The base portion has an axial length shorter than that of the shank portion.

Each of the above portions define a cavity such as base portion cavity 11(*a*), shank portion cavity 12(*a*), and mouth portion cavity 13(*a*) therewithin. Each of these cavities is, as shown, in communication with the other. As shown, base portion 11 and cavity 11(*a*) are defined by a sidewall 14 which is relatively thin as compared to shank portion sidewall 15, which is relatively thick.

Figure 1:
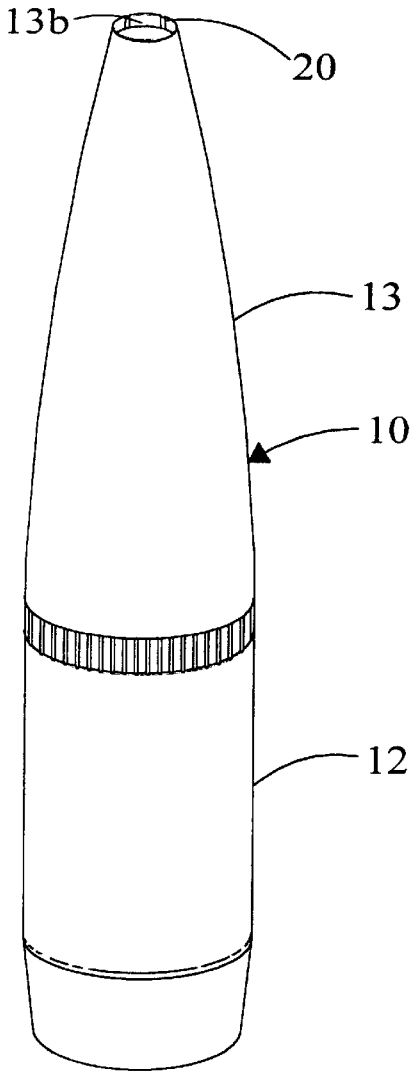
FIG. 1 is a perspective view of one of our wide-velocity-performance-range bullets constructed in accordance with my invention.

Sidewall 16 defines cavity 13(*a*) and is thinner, in general, than sidewall 15 of shank portion 12. As best shown in FIG. 1, sidewall 16, when formed into the bullet, tapers inwardly from shank portion sidewall 15 to the mouth 13(*b*) of mouth portion 13. Sidewall 15 of shank portion 12, shown in FIG. 2, is substantially harder than the sidewall 16 of mouth portion 13 by about 20 DPH. The preferred peak hardness of sidewall 15 is 145 DPH. Thus, the peak hardness of sidewall 15 of shank portion 12, shown in FIG. 2, is about 20 DPH greater than the hardness of the rear end of sidewall 16 of mouth portion 13.

The hardness of the shank portion 12 is at a maximum at its rear end and has an average hardness thereat of 145 DPH and decreases in hardness to an average of 125 DPH at the forward end of the shank portion. The value of hardness of the shank portion 12 may vary from 125 to 165 DPH at the rear end and from 105 to 145 DPH at the forward end. Thus, the average hardness decreases approximately 20 DPH from the rear end to the forward end of the shank portion, and the shank portion has a peak hardness of about 20 DPH greater than the hardness of the mouth portion at its intersection with the rear end of the mouth portion. However, we have made satisfactory bullets in which this difference is as great as 40 DPH. The mouth portion preferably has a hardness of about 125 DPH at that intersection.

The hardness of the mouth portion 13 in the unprofiled jacket, as shown in FIG. 2, maintains a relatively constant hardness of an average of 125 DPH. The value of its hardness in its unprofiled state may vary from 115 to 135 DPH.

Figure 3:
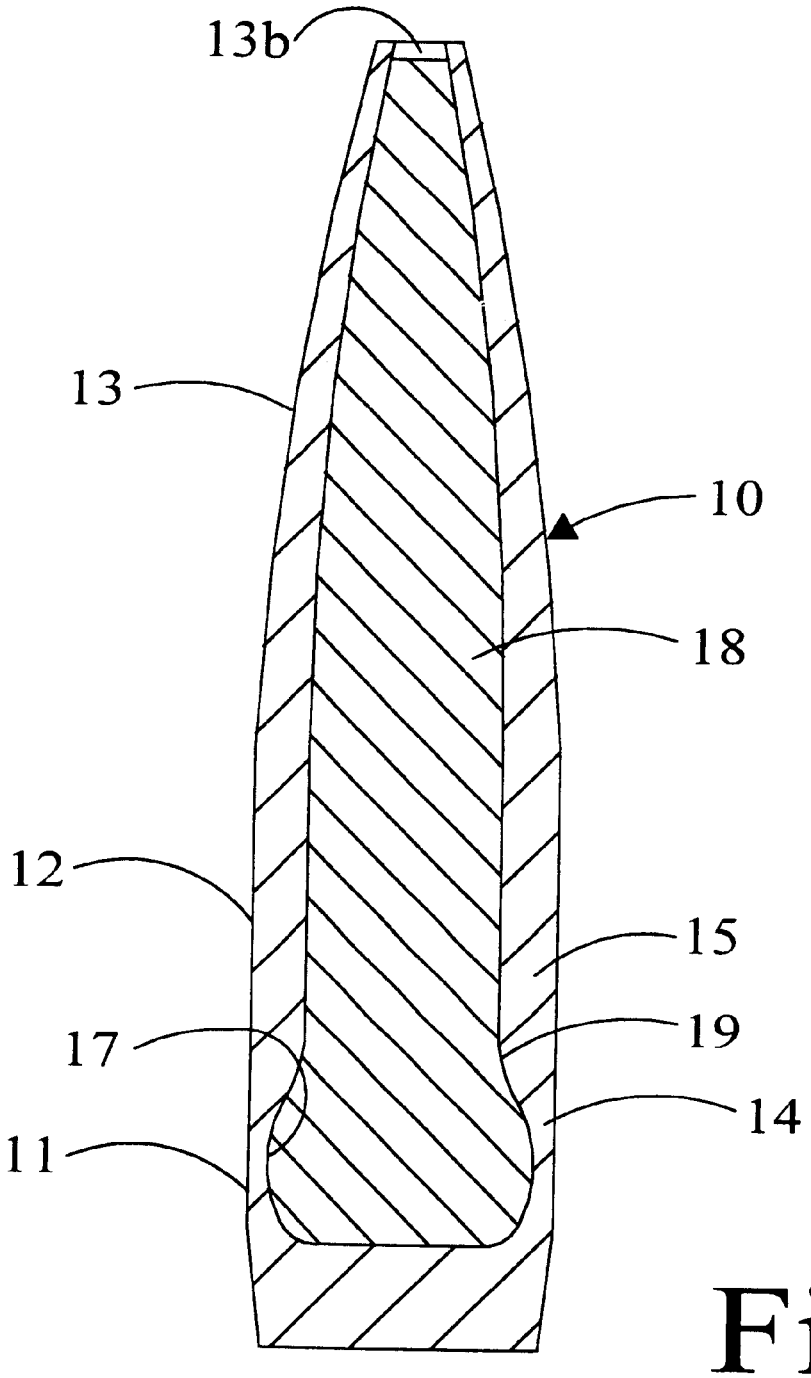
FIG. 3 is a longitudinal sectional view of my bullet in its completed form.

The process of forming the ogive profile in the jacket, as shown in FIGS. 1 & 3, increases the hardness of the forward end of the mouth portion by approximately 20 DPH.

The tapered mouth portion 13 of my bullet is scored internally, as indicated by numeral 20. As best shown in FIG. 3, its sidewall 16 tapers inwardly toward the mouth 13(*b*) and gradually thins, as viewed from the shank portion area toward and to the mouth 13*b*.

Extending between the forward end of sidewall 14 of base portion 11 and the trailing end of sidewall 15 of shank portion 12, is an annular transition shoulder 17 which functions to lock the lead core 18 within the jacket 10. This shoulder extends radially inwardly a minimum of 0.020" and thereby causes the diameter of the cavity 11(*a*) to be a minimum of 0.04" greater in diameter than the diameter of the shank portion cavity 12(*a*). The shoulder 17 extends at an angle to the longitudinal axis of the jacket 10 of at least 7.5 degrees. As a consequence, the shoulder 17 constitutes a consistently successful mechanical lock of metal core 18 within the interior of the jacket 10.

As shown, shoulder 17 terminates at point 19 which is at the inner surface of sidewall 15 of shank portion 12. As shown, it extends inwardly along an axial distance of 0.090", slightly more than the thickness of sidewall 15 of shank portion 12. As a consequence, shoulder 17 extends radially inwardly at least 0.02" which creates a minimum difference between the internal diameter of sidewall 14 and sidewall 15 of no less than 0.04". Shoulder 17 may extend radially inwardly as much as 0.035" or more.

To ensure that shoulder 17 will extend at an angle to the longitudinal axis of jacket 10 no less than 7.5 degrees and have adequate length to accomplish its lock-in function, the cavity 11(*a*) of base portion 11 has an axial length of at least 0.060". The preferred axial length of base portion cavity 11(*a*) is about 0.125".

Since shoulder 17 extends radially inwardly a substantial radial distance, the diameter of base portion cavity 11(*a*) exceeds the diameter of shank portion cavity 12(*a*) by at least 25% of the diameter of shank portion cavity 12(*a*).

As shown in FIG. 3 and in the test results shown hereinafter, the diameter of the cavity 11(*a*) of base portion 11 of the jacket 10 is within the range of approximately 25–40% larger than the diameter of the shank cavity 12(*a*). The minimum and maximum values are likely to be different with each caliber, i.e., the smaller caliber's have smaller diameter values, and the larger caliber's have larger diameter values. The primary requirement is that a minimum of 0.040" difference in diameter be provided.

Wherever hereinafter the term "substantially harder" is utilized, it is intended to indicate that the rearmost shank portion of the claimed bullet is about 20 DPH harder than the rearmost portion of the mouth portion thereof. Similarly, wherever hereinafter the term "substantially softer" is utilized, it is intended to indicate that the mouth portion of bullet jacket 10 at its rear end is approximately 20 DPH less hard than the rear end of the sidewall 15 of the bullet.

I have done a fairly large of amount of testing to date on the 0.30 caliber bullet and a relatively small amount with respect to the 0.243 caliber bullet. No testing of other caliber bullets has been completed to date. Set forth hereinbelow are the results of such testing and our approximations of the anticipated measurements for the other indicated caliber's. This table lists the proposed wall thickness of the jacket walls for the indicated caliber's but, as indicated above, only the 0.30 and 0.243 caliber bullets have actually been manufactured and tested. As a consequence, the wall thickness with respect to the other caliber's may be modified as the development proceeds. The cavity diameters refer to the resulting diameters in inches at the ends of the locking feature, which is the transition shoulder 17.

| | CAVITY DIAMETERS | | | JACKET WALL THICKNESS | | |
|---|---|---|---|---|---|---|
| | Large | Small | Ratio | Thick | Thin | Ratio |
| 338 Cal | 0.268 | 0.206 | 1.30 | 0.065 | 0.034 | 1.90 |
| 30 Cal | 0.240 | 0.184 | 1.30 | 0.061 | 0.033 | 1.84 |
| 284 Cal | 0.218 | 0.162 | 1.35 | 0.060 | 0.032 | 1.86 |
| 270 Cal | 0.214 | 0.160 | 1.34 | 0.058 | 0.031 | 1.87 |
| 264 Cal | 0.203 | 0.150 | 1.35 | 0.056 | 0.030 | 1.89 |

-continued

| | CAVITY DIAMETERS | | | JACKET WALL THICKNESS | | |
|---|---|---|---|---|---|---|
| | Large | Small | Ratio | Thick | Thin | Ratio |
| 25 Cal | 0.198 | 0.146 | 1.36 | 0.055 | 0.029 | 1.90 |
| 243 Cal | 0.184 | 0.133 | 1.38 | 0.054 | 0.029 | 1.88 |

The jacket wall thickness indicated below the word "Thick" in the above table pertains to the shank sidewall 15, and the figures in the column below the word "Thin" pertains to the base portion sidewall 14.

Based upon our test results the thickness of the shank sidewall is most likely to be within the range of 0.054"–0.065" and the thickness of the base portion sidewall within the range of 0.029"–0.034". Based upon my experience and testing, it appears that the possible range of the shank portion sidewall thickness is about 0.045"–0.070". Likewise, it appears that the possible range of the base portion sidewall thickness is about 0.025"–0.050".

The above table shows the minimum and maximum wall thickness of the results obtained by our testing and of my approximations of the minimum and maximum values which I would anticipate to find with the respective other caliber's. The primary requirement is the minimum radial interference of 0.020". If the interference is less than this value, the testing indicates that the core is likely to pull out upon impact. It should be borne in mind that the interference of 0.020" produces an included value of 0.040", which is reflected in the difference in diameter between the shank portion cavity and the base portion cavity.

The transition angle (a minimum of 7.5 degrees) is the effective angle of shoulder 17 extending between the thin wall section (14) and the thick section (15) of the jacket wall, relative to the longitudinal axis of the jacket 10. If this angle is too low, below about 15 degrees included (7.5 degrees per side), then the core will pull out on impact. The more this angle is increased the better the core is retained. However, as the angle is increased it becomes more difficult to manufacture the jacket. A jacket with a 90 degree angle (45 degrees per side) is probably the upper limit of what can be manufactured, except by machining. If the jacket were to be machined, the included angle could be as much as 180 degrees, but this would be relatively expensive to produce. The less expensive procedures which can be utilized to practice the invention are the conventional forming procedures utilized in the manufacturing of similar but less effective bullets.

In my opinion, the minimum transition angle between the large (11*a*) and small (12*a*) cavities is 15 degrees (included). The desired angle would be 25–45 degrees (included) and the maximum would be 90 degrees (included). The prior art known to me fails to show a locking shoulder with an angle such as I am disclosing and claiming herein.

Wherever hereinafter the length of the base portion cavities is referenced, it is intended to refer to the length of the base portion rearward of the transition shoulder.

The axial length of the base portion cavity 11(*a*) is important. If the length is too short, then the core can easily pull out on impact. If it is too long and the mushroom upsets beyond the transition shoulder 17, then the locking feature will be effectively removed and the core will pull out on impact. The ideal length is one which is as long as possible but still short enough to retain the locking transition area after the bullet has mushroomed. This length will vary with bullet weight (i.e., heavier bullets are longer to start with) and velocity. Following are some values which I believe are possible:

| Caliber | Weight | Base Cavity with Transition Shoulder Length | Shoulder Length | Base Cavity Length Behind Shoulder |
|---|---|---|---|---|
| .30 | 150 gr. | .150" | .090 | .060" |
| .30 | 180 gr. | .320" | .090 | .230" |

The minimum length of the cavity 11(*a*) should be 0.060" and the preferable length should be 0.125" (for a 30-06, 150 grain bullet). I believe there is no possible maximum length value because, as indicated above, the mushroom will upset beyond the transition, thereby effectively removing the locking feature and the core will pull out upon impact.

To obtain the best core-retaining features, three (3) requirements must be met. It should be noted that any feature which aids in retaining the core within the jacket will tend to reduce the amount of core separation. The difference between the large(11*a*) and small(12*a*) diameters must be at least as large as 0.040". As described above, this is obtained by having a 0.020" transition shoulder interference. A second requirement is that the actual length of the large diameter cavity 11(*a*) (and, consequently, of the portion of the core seated therein) must be effectively as long as 0.060". A third requirement is that the transition angle should be at least 15 degrees (7.5 degrees included). I have found that the three (3) requirements outlined above are important to have a high confidence that the core will be retained within the jacket. Some of the bullets described in the prior art will work to a small degree, but not enough to consistently cause the core to be retained within the jacket.

The performance window of my above bullet has been widened substantially. This has been accomplished as a result of making the mouth portion of the jacket substantially softer than the shank portion. As a consequence thereof, my bullets will initiate mushrooming at much lower velocities (long range shots) than those currently being marketed with a performance window of 2,000 fps–2,700 fps. My same bullets will perform successfully under high velocity conditions (short range shots), since the hard shank will stop the mushrooming and will withstand the severe stress loads imposed upon the jacket upon impact. We have found that 98–100% of our firing of this bullet will retain their lead core at high velocities. Thus, it can be seen that I have succeeded in widening the performance window of such bullets, which can be manufactured nearly as inexpensively as those currently marketed with a performance window of only 2,000 fps–2,700 fps. Clearly, optimizing the hardness and thickness of the bullet jacket significantly improve the overall performance of a bullet over a wider range of velocities.

It will, of course, be understood that various changes may be made in the form, details, arrangement and proportions of the parts without departing from the scope of the invention which comprises the matter shown and described herein and set forth in the appended claims.

What is claimed is:

1. An increased velocity-performance-range bullet comprising:

a) a metal bullet jacket having sidewalls defining integral base, shank and mouth portions;

b) said sidewalls of said shank portion and said base portion being of uniformly generally cylindrical exterior size and shape and each defining a cavity therewithin;

c) said base portion sidewall being thin radially relative to said sidewall of said shank portion, and defining an interior cavity of relatively large diameter as compared to said cavity defined by said shank sidewall;

d) said shank portion sidewall having its interior cavity in communication with said base portion cavity and being generally substantially harder than said mouth portion sidewall;

e) said mouth portion sidewall being relatively thin as compared to said shank portion sidewall and defining a mouth portion cavity which tapers inwardly from said shank portion to the mouth of said mouth portion and communicates with said shank portion cavity;

f) a metal core seated within said cavities in non-bonded relation to said jacket and under sufficient pressure to fill said cavities in their entireties; and g) said relatively thin base portion sidewall joining said relatively thick shank portion sidewall in the form of an inwardly extending annular shoulder which provides an interference of at least 0.020".

2. The bullet defined in claim 1, wherein the diameter of said base portion cavity exceeds the diameter of said shank portion cavity by at least 25% of said shank portion cavity diameter.

3. The bullet defined in claim 1, wherein the thickness of said shank portion sidewall exceeds the thickness of said base portion sidewall by at least 80% of said base portion sidewall thickness.

4. The bullet defined in claim 1, wherein said base portion cavity has an axial length of at least 0.06".

5. The bullet defined in claim 1, wherein said base portion cavity has a preferred axial length of about 0.125".

6. The bullet defined in claim 4, wherein said shank portion sidewall peak hardness is about 20 DPH harder than its mouth portion minimum sidewall hardness.

7. The bullet defined in claim 1, wherein said mouth portion sidewall has a hardness of about 105–145 DPH at the rear end of the mouth portion.

8. The bullet defined in claim 1, wherein said shank portion sidewall has a peak hardness of about 145 DPH and said mouth portion sidewall has a hardness of about 125 DPH at the rear end of the mouth portion.

9. The bullet defined in claim 1, wherein said base portion cavity has a diameter 25–40% larger than the diameter of said shank portion cavity.

10. The bullet defined in claim 1, wherein the diameter of said base portion cavity exceeds the diameter of said shank portion cavity by at least 0.040".

11. The bullet defined in claim 1, wherein said shank portion sidewall has a hardness which exceeds the hardness of said minimum mouth portion by about 20 DPH.

12. The bullet defined in claim 1, wherein said shank portion sidewall has a hardness of about 125–165 DPH at its rear end and said mouth portion sidewall has a hardness of about 105–145 DPH at its rear end.

13. The bullet defined in claim 1, wherein said mouth portion sidewall has a hardness of about 125 DPH at its rear end.

14. The bullet defined in claim 1, wherein said shank portion has a peak hardness of about 125–165 DPH at its rear end.

15. The bullet defined in claim 1, wherein said mouth portion sidewall has a hardness of about 105–145 DPH adjacent its intersection with said shank portion sidewall.

16. The bullet defined in claim 1, wherein said shank portion sidewall has a hardness of about 125–165 DPH at its rear end.

17. The bullet defined in claim 1, wherein said mouth portion has a hardness of about 125 DPH at its rear end and said shank portion has a hardness of about 145 DPH at its rear end.

18. The bullet defined in claim 1, wherein said shank portion sidewall is at least 20 DPH harder than the mouth portion minimum sidewall hardness.

19. The bullet defined in claim 1, wherein said shank portion sidewall has a thickness within range of about 0.045–0.070" and said base portion sidewall has a thickness within a range of about 0.025–0.050".

20. The bullet defined in claim 1, wherein shank portion sidewall is generally substantially harder than said mouth portion sidewall and increases in hardness rearwardly from its intersection with said mouth portion.

21. The bullet defined in claim 1, wherein said shank portion sidewall has a diameter at least 25–40% less than the diameter of said base portion cavity.

22. The bullet defined in claim 1, wherein the ratio of the thickness of said shank portion sidewall to the thickness of said base portion sidewall is within the range of about 1.84 to 1.90.

23. The bullet defined in claim 1, wherein said base portion includes an annular transition shoulder extending radially inwardly from a point adjacent said base portion sidewall to said shank portion sidewall, a radial distance slightly less than the thickness of said base portion sidewall.

24. An increased velocity-performance-range bullet comprising:

a) a metal bullet jacket having sidewalls defining integral base, shank and mouth portions;

b) said sidewalls of said shank portion and said base portion being of uniformly generally cylindrical exterior size and shape;

c) said base portion sidewall being relatively thin radially and defining an interior cavity;

d) said shank portion sidewall being relatively thick radially, as compared to said base portion sidewall, and defining an interior cavity which communicates with said base portion cavity;

e) said shank portion sidewall being generally substantially harder than said mouth portion sidewall;

f) said mouth portion sidewall being relatively thin as compared to said shank portion sidewall and defining a mouth portion cavity which tapers inwardly from said shank portion to the mouth of said mouth portion and communicates with said shank portion cavity;

g) an annular transition shoulder carried by said base portion sidewall and extending a radial distance of at least 0.20" inwardly from said base portion sidewall to the interior surface of said shank portion sidewall; and h) a metal core seated within said cavities in non-bonded relation to said jacket and under sufficient pressure to fill said cavities in their entireties.

25. The bullet defined in claim 24, wherein said transition shoulder extends radially inwardly a distance exceeding 28% of the radial thickness of said sidewall of said shank portion and constitutes a mechanical lock of the portion of said metal core disposed within said base portion.

26. The bullet defined in claim 24, wherein said transition shoulder extends radially inwardly a distance slightly less than the thickness of said base portion sidewall.

27. The bullet defined in claim 24, wherein said shoulder extends at an angle no less than 7.5 degrees relative to the longitudinal axis of said jacket.

28. The bullet defined in claim 24, wherein the difference between the internal diameter of said sidewall of said base portion and of said sidewall of said shank portion is at least 0.040".

29. The bullet defined in claim 24, wherein the difference between the internal diameters of said shank portion sidewall and said base portion sidewall of said shank portion is within the range of 0.040" and 0.070".

30. The bullet defined in claim 24, wherein the axial length of said base portion cavity is at least 0.060".

31. The bullet defined in claim 24, wherein the preferred axial length of said base portion cavity is about 0.125".

32. The bullet defined in claim 24, wherein the diameter of said base portion cavity exceeds the diameter of said shank portion cavity by at least 25% of the diameter of said shank portion cavity.

33. The bullet defined in claim 24, wherein said differences in the thicknesses of said shank and base portion sidewalls are incorporated within an annular abrupt shoulder extending therebetween.

34. An increased velocity-performance-range bullet comprising:

(a) a metal bullet jacket having sidewalls defining integral base, shank, and mouth portions;

(b) said sidewalls of said shank portion and said base portion being of uniformly generally cylindrical exterior size and shape, said shank portion sidewall having a thickness within a range of about 0.045–0.070" and said base portion sidewall having a thickness within a range of about 0.025–0.050";

(c) said mouth portion sidewall being substantially softer than said shank portion sidewall by about 20–40 DPH, said shank portion sidewall having a hardness of about 145 DPH adjacent its rear end;

(d) said sidewalls of said base, shank and mouth portions defining interconnected cavities therewithin;

(e) a metal core seated within said cavities in non-bonded relation to said jacket and under sufficient pressure to fill said cavities in their entireties; and (f) said relatively thin base portion sidewall joining said relatively thick shank portion sidewall in the form of an inwardly extending angular shoulder which provides an interference of at least 0.020".

35. The bullet defined in claim 24, wherein said shank portion sidewall has a hardness which exceeds the minimum hardness of said mouth portion sidewall by about 20 DPH.

36. An increased velocity-performance range bullet comprising:

a) a metal bullet jacket having sidewalls defining at least mouth, shank, and base portions which are integral;

b) each of said portions defining a cavity which communicates with the cavities of the others;

c) said sidewall of said shank portion having a peak hardness of about 20 DPH greater than the hardness of said mouth portion at the intersection of said shank sidewall with the rear end of said mouth portion;

d) said mouth portion having a hardness of about 125 DPH at its intersection with said shank portion; and e) a metal core seated within said cavities in non-bonded relation to said jacket and under sufficient pressure to fill said cavities in their entireties.

37. An increased velocity-performance-range bullet comprising:

(a) a metal bullet jacket having sidewalls defining integral base, shank and mouth portions;

(b) said sidewalls of said shank portion and said base portion defining a cavity within each which communicates with the other said shank portion sidewall having a thickness within a range of about 0.045–0.070" and said base portion sidewall having a thickness within a range of about 0.025–0.050";

(c) the diameter of said base portion cavity exceeding the diameter of said shank portion cavity by more than 0.040";

(d) a metal core seated within said cavities in non-bonded relation to said jacket and under sufficient pressure to fill said cavities in their entireties; and (e) said relatively thin base portion sidewall joining said relatively thick shank portion sidewall in the form of an inwardly extending angular shoulder which provides an interference of at least 0.020".

38. An increased velocity-performance-range bullet comprising:

a) a metal bullet jacket having sidewalls defining at least shank and mouth portions which are integral, the rear end of said mouth portion joining the forward end of said shank portion;

b) each of said portions defining a cavity which communicates with the cavity of the other;

c) said sidewall of said shank portion diminishing in hardness from its rear end toward its forward end;

d) said mouth portion diminishing in its hardness from its forward end toward its rear end;

e) said sidewall shank portion having a hardness of about 125–165 DPH at its rear end and having a hardness of about 105–145 DPH adjacent its forward end;

f) said mouth portion having a hardness of about 105–145 DPH adjacent its rear end and a hardness of about 125–165 DPH adjacent its mouth; and g) a metal core seated within said cavities in non-bonded relation to said jacket and under sufficient pressure to fill said cavities in their entireties.

39. The improved bullet defined in claim 36, wherein said mouth sidewall has a hardness of about 125 DPH adjacent its rear end.

40. The improved bullet of claim 36, wherein said mouth sidewall has a hardness of about 145 DPH adjacent its mouth.

41. The improved bullet of claim 36, wherein said shank sidewall has a hardness of about 125 DPH adjacent its forward end.

42. The improved bullet of claim 36, wherein said shank sidewall has a hardness of about 145 DPH adjacent its rear end.

* * * * *

UNITED STATES PATENT AND TRADEMARK OFFICE

CERTIFICATE OF CORRECTION

PATENT NO. : 6,244,187 B1
DATED : June 12, 2001
INVENTOR(S) : Lawrence P. Head

It is certified that error appears in the above-identified patent and that said Letters Patent is hereby corrected as shown below:

Claim 6,
Line 1, delete "Claim 4" and insert -- Claim 1 --.

Signed and Sealed this

Twenty-sixth Day of February, 2002

*Attest:*

*Attesting Officer*

JAMES E. ROGAN
*Director of the United States Patent and Trademark Office*